United States Patent [19]

Logan

[11] 4,098,493

[45] Jul. 4, 1978

[54] WOVEN WIRE PARTITION

[75] Inventor: Zack H. Logan, Louisville, Ky.

[73] Assignee: A-T-O Inc., Willoughby, Ohio

[21] Appl. No.: 776,504

[22] Filed: Mar. 11, 1977

[51] Int. Cl.[2] ..... E04H 17/16

[52] U.S. Cl. ..... 256/24; 256/47; 160/371; 52/581

[58] Field of Search ..... 256/24, 47, 32, 25; 52/581, 626; 160/371

[56] References Cited

U.S. PATENT DOCUMENTS

| | | | |
|---|---|---|---|
| 1,540,788 | 6/1925 | McClure | 52/626 |
| 2,205,519 | 6/1940 | Elber et al. | 52/474 |
| 3,414,237 | 12/1968 | Bishoff, Sr. et al. | 256/24 |

*Primary Examiner*—Andrew V. Kundrat

*Attorney, Agent, or Firm*—Wood, Herron & Evans

[57] ABSTRACT

An improved woven wire partition that includes a frame fabricated of at least one channel member, that channel member opening outwardly relative to the center of the frame. A woven wire panel is connected with the frame, wire ends of the woven wire panel passing through holes in the channel member's center web and being folded over that center web to maintain the woven wire panel in connected relation therewith. At least one novel U-shaped clip is mounted in the trough of the channel member by frictionally interposing the clip's base between a folded wire end and the channel member's center web. The U-shaped clip's legs are sized to extend beyond the side edges of the channel member, and are configured to be received in an interference fit relation with the sides of an outwardly opening channel member of an adjacent woven wire partition when the two channel members are bolted together in side edge-to-side edge relation. The clip functions to align initially the two channel members in tubular post configuration during assembly, and to prevent subsequently those channel members from moving laterally relative one to the other so as to eliminate misalignment or telescoping problems as the channel members are bolted together.

8 Claims, 5 Drawing Figures

WOVEN WIRE PARTITION

This invention relates to an improved woven wire partition.

Woven wire partitions are very well known to the prior art. Basically, a woven wire partition is comprised of a frame of, for example, rectangular configuration. A woven wire panel is interconnected with the frame so as to define the woven wire partition. Woven wire partitions are often used for area separation in and around factories, warehouses, schools, stores, public buildings and the like. Typically, and for example, a series of woven wire partitions, in the form of side wall panels and ceiling panels, may be connected together in edge-to-edge relation so as to define an enclosure such as a stock room. Also for example, a series of woven wire partitions may be connected together in side edge-to-side edge relation so as to define an interior fence separating two adjacent work areas one from the other. In use, the woven wire partitions are commonly bolted together in edge-to-edge relation one with the other.

The frame members of a woven wire partition must, of course, provide rigidity to the partition since the woven wire panel is relatively flexible without a frame. One type frame member known to the prior art for woven wire partitions is known as a channel member. The channel members may be welded or otherwise fixed together in, for example, rectangular configuration, those channel members facing or opening outwardly from the woven wire panel. The wire ends of the woven wire panel are connected with the bar channel frame simply by passing those ends through holes in the channel members' center webs, and then folding or crimping same over against the exterior faces of those webs.

However, frames fabricated of channel members provide problems during connection of two woven wire partitions in coplanar relation one with the other, i.e., during assembly of the woven wire partitions into a fence, for example. In such assembly, the side edges of adjacent channel members are brought into contacting relation one with the other so those channel members can be bolted together, thereby connecting one partition with the other. But as the channel members of adjacent partitions are drawn down tight by tightening the connecting bolts, the channel members often misalign or slip laterally relative one to the other, i.e., the adjacent channel members often telescope into one another. The cumulative effect of this telescoping problem, if not solved, can be a loss of several inches or more depending on the total length of the partition run, i.e., the number of partition joints from one end of the partition run to the other. Further, such misalignment of adjacent channel members results in an unworkmanlike appearance of the finished installation. But perhaps most importantly, the problem requires added installation time as bolts must be unloosened, and channel members must be pulled back and realigned, when the telescoping problem occurs before finally tightening down the bolts. In addition, and after assembly and during use, if a lateral blow of significant force is rendered to any frame member in a partition run, a domino like crackling sound can be heard up and down the run as the compressive forces imposed by the connector bolts are relieved through the telescoping of the adjacent channel members.

There are currently three basic structures, of which I am aware, directed to this telescoping or misalignment problem upon assembly of a plurality of woven wire partitions into a multi-partition run. A first approach involves placing a plurality of plugs in the channel troughs of adjacent channel members. This approach is illustrated in U.S. Pat. No. 3,414,237 assigned to the assignee of this application. However, the dimensional tolerance range in the trough area of channel members as manufactured is relatively broad, and as a result from a practical standpoint the plugs must be fabricated to fit in channel members of the minimum dimension. When the channel members' trough dimensions run to the maximum of the tolerance range, the legs of adjacent partitions' channel members can be made to telescope as those channel members are bolted together. And even when the channel members do not telescope into one another, the plug approach does not aid in initially aligning the adjacent channel members one with the other prior to bolting those members together. A second approach has been the use of block C-shaped channel members, instead of the straight side channel members referred to above, for the partitions' frames. This second approach is illustrated in U.S. Pat. No. 2,205,519, see particularly FIGS. 12, 14 and 15. These block C-shaped members will not permit telescoping. However, and from a practical standpoint, the manufacturer of woven wire partitions using block C-shaped channel members must lighten the gauge or thickness of the material from which it is fabricated so as to be competitive. The result is a partition frame in which the channel members' legs can easily collapse, and in which the channel members can be more readily dented and distorted by normal industrial traffic. A third approach to the problem involves aligning the adjacent channel members by hand, and then applying a number of C-clamps to the exterior of the aligned channels. The connector bolts are then torqued down with the exterior C-clamps in place. This approach is relatively time-consuming, and awkward, when assembling an extended length run of woven wire partitions.

It has been one objective of this invention to provide a novel alignment clip for use with a woven wire partition, the partition having a frame that includes at least one outwardly opening channel frame member.

It has been another objective of this invention to provide a woven wire partition with a frame comprised of at least one channel member, the channel member being oriented to open outwardly relative to the center of the partition, and at least one U-shaped clip mounted in the trough of that channel member, the clip being retained in that trough by a friction connection provided by a wire end of the woven wire panel, and the clip having legs extending beyond the channel member's side edges so that the clip's legs may interfit with the legs of a second partition's outwardly facing adjacent channel member. This structure allows the second partition's channel member to be easily aligned initially with the first partition's channel member prior to bolting the channels together, thereby preventing misalignment and telescoping of the second channel member with the first channel member as the bolts are tightened, and subsequently during use.

Other objectives and advantages of this invention will be more apparent from the following detailed description taken in conjunction with the drawings in which.

Figure 1:
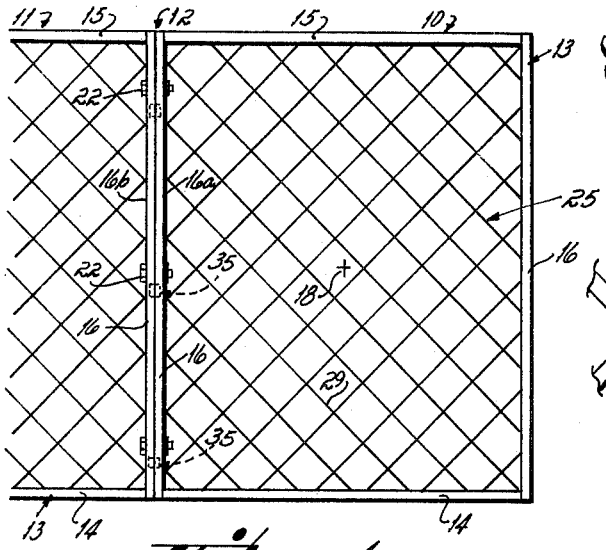
FIG. 1 is a side elevational view illustrating a first woven wire partition connected to a second woven wire partition, those woven wire partitions being fabricated in accord with the principles of this invention.
Figure 5:
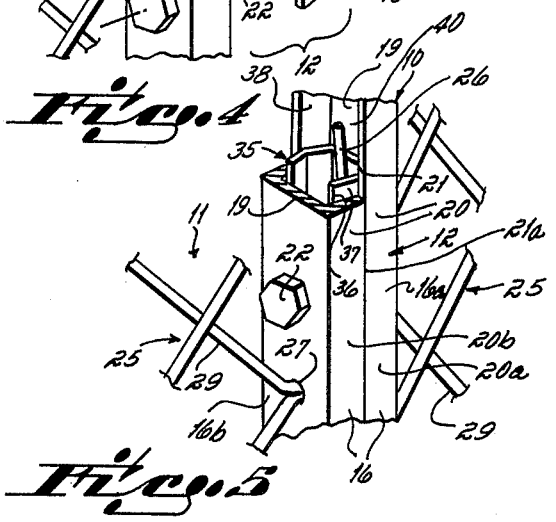
FIG. 5 is a view similar to FIG. 4 but illustrating the channel member of the first partition in connected relation with adjacent channel member of the second partition.
Figure 2:
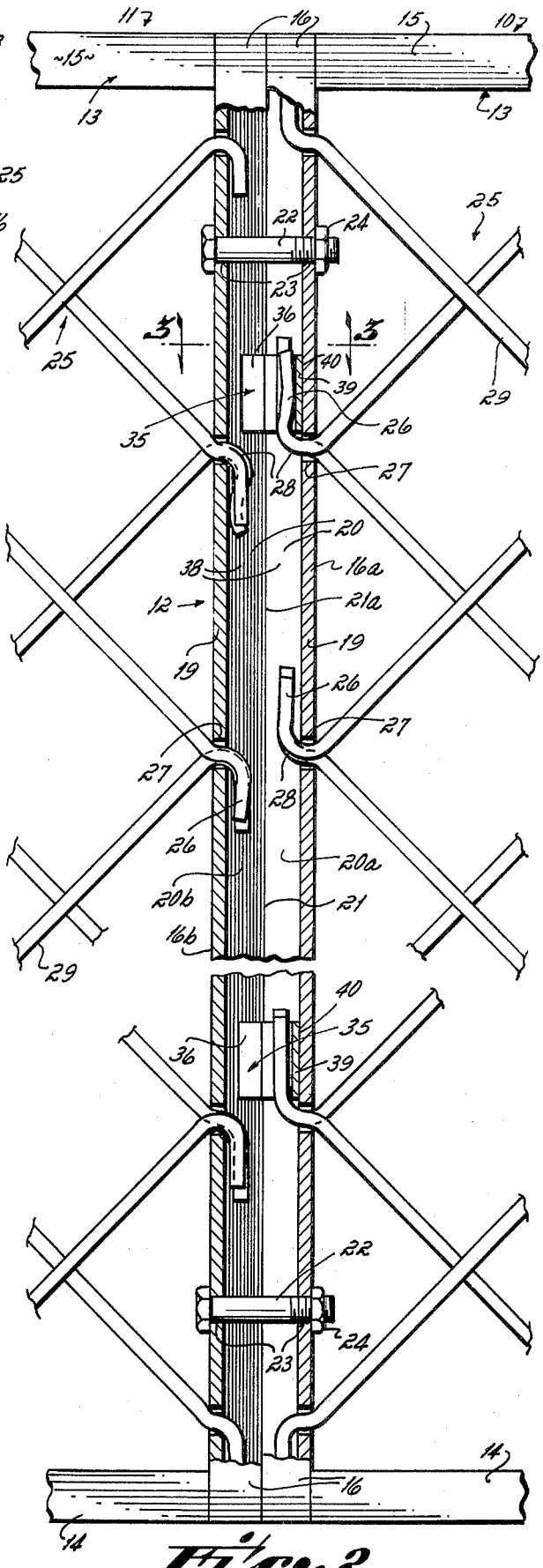
FIG. 2 is a partially broken away side view illustrating the connection joint of the first partition with the second partition.

A first woven wire partition 10 in accord with the principles of this invention is shown connected to a second woven wire partition 11 at a vertical post 12 in FIG. 1. Each woven wire partition 10, 11 includes a frame 13, that frame being comprised of a lower channel member 14, an upper channel member 15, and side channel members 16, all welded or otherwise fixed together one to the other. Each of the channel members 16 is comprised of a center web 19 and straight side walls 20, those side walls defining side edges 21. Note that the channel members **16*a*, 16*b* of adjacent partitions 10, 11 open outwardly away from the center 18 of their respective frames. Note further that the channel members' side edges 21 are in direct contact when the first partition's side channel member 16*a* is aligned in tubular post configuration with the second partition's side channel member 16*b*, i.e., when the partitions 10, 11 are in coplanar and bolted together relation as shown in FIGS. 1, 2 and 5. The vertical channel members 16*a*, 16*b* of adjacent partitions 10, 11 are tightly connected together by bolts 22 that extend through aligned holes 23 in the channel members' center webs, and by nuts 24, those channel members 16*a*, 16*b* cooperating to define post 12 upon connection of the two partitions 10, 11. The nuts 24 are torqued down quite tightly to provide a degree of structural coplanar integrity between the adjacent partitions 10, 11**.

Each partition 10, 11 also includes a woven wire panel 25 connected along each edge of its frame's four channel members 14–16 in the manner shown in FIG. 2. The wire ends 26 of the panel 25 extend through holes 27 in the channel members' center webs 19, and are crimped or folded over as at 28 to anchor the panel's wire 29 in position with the partition's frame 13. It is known to anchor or connect a panel's wires 29 to a partition's frame 13 as shown in woven wire partitions of this type.

The novel alignment clip 35 adapted for use with a woven wire partition 10, 11 is particularly illustrated in FIGS. 2–5, As shown therein, the clip 35 is of a basically U-shaped cross-sectional configuration, the exterior cross-sectional configuration thereof conforming to the interior cross-sectional configuration of the channel member **16*a* to which it is to be connected. In other words, the clip 35 is sized and configured to fill substantially the trough or cavity of that partition frame's channel member with which it is connected, see FIG. 3. Furthermore, and also as illustrated in that FIG. 3, the legs 36 of the U-shaped clip 35 are of a length L substantially greater than the length L′ of the sides 20*a* of the channel member 16*a*. Thus, the clip's legs 36 extend substantially beyond the side edges 21*a* of the channel member 16*a* when the clip is assembled therewith, see particularly FIGS. 3 and 4. Further, the distance D between the clip's legs 36 is sized to provide an interference fit between the exterior faces 37 of those legs and the inner faces 38 of an adjacent channel member's sides 20*b* when that adjacent channel member 16*b* is bolted to the channel member 16*a*, see FIGS. 3 and 5**.

Figure 4:
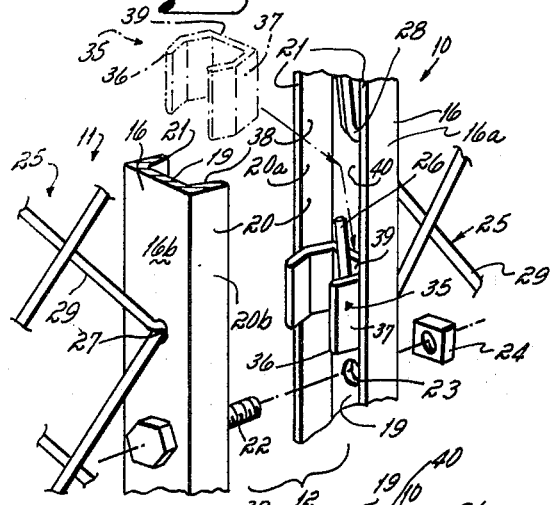
FIG. 4 is a perspective view illustrating assembly of an alignment clip with a channel member of the first partition.

In assembly of two adjacent woven wire partitions 10, 11 clip 35 is first connected or mounted in the trough of a first channel member **16*a* in close proximity to a bolt hole 23, see FIGS. 1 and 2. As illustrated in FIG. 4, this connection is accomplished by simply inserting the clip's base 39 between wire ends 26 from the woven wire panel 25 which are folded over onto the interior face 40 of that channel member 16*a*. The wire ends 26, which are used to anchor the woven wire panel 25 to the channel members 14–16 as previously explained, act in the nature of spring connectors for retaining the clips 35 in fixed relation with the channel member 16*a*. This makes installation of the clips 35 on the channel member 16*a*** quite easy and, indeed, permits manual installation with only one hand.

Figure 3:
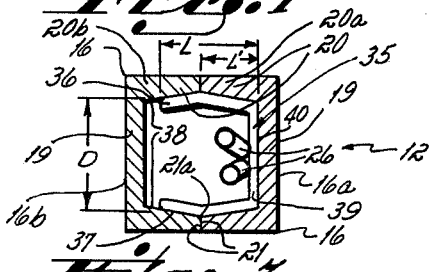
FIG. 3 is a cross-sectional view taken along line 3—3 of FIG. 2.

Once the clips 35 have been positioned along the length of the channel member **16*a* (a clip being provided adjacent each proposed bolt 22 connection for the partition 10 as illustrated in FIGS. 1 and 2), the second or adjacent partition 11 is brought into juxtaposition with the first partition 10. In the juxtaposed attitude, the adjacent channel member 16*b* is located in side edge 21-to-side edge 21 alignment with the first channel member 16*a* as illustrated in FIG. 3. This initial vertical alignment of the juxtaposed channel members 16*a*, 16*b* is easy to achieve because the clips' legs 36 provide an interference fit with the adjacent channel member's sides 20*b*, thereby initially aligning the second channel member 16*b* with the first channel member 16*a* prior to bolting those members together. Subsequently, the first 16*a* and second 16*b* channel members are bolted together by bolts 22 and nuts 24 as illustrated in FIGS. 2, 4 and 5, thereby connecting the first partition 10 with the second partition 11 in assembled relation. The bolts and nuts may be drawn or torqued down very tight without one channel member 16*a* or 16*b* moving laterally relative to the other, i.e., without a telescoping problem arising within post 12 during connection of the partitions 10, 11**.

The use of the U-shaped clips 35 in combination with the channel members 16 in the woven wire partition 10 of this invention provides a couple of major advantages in practice. First, the clips 35 are very easy to install with the channel members 16; in other words, no special accommodation is required in assembly of the woven wire partition 10 in the first instance, and no unbending and rebending of wire ends 26 of the woven wire panel 25 is required to permit connection of the clips with the channel members. Second, the U-shaped clips 35 permit easy and simple initital alignment of adjacent channel members **16*a*, 16*b* of adjacent woven wire partitions 10, 11 prior to bolting same together due to the extension of each clip's legs 36 beyond the side edges 21 of that channel member 16 to which it is attached. Third, the clips 35 prevent telescoping the channel members 16*a*, 16*b* as those members are drawn together by bolts 22 and nuts 24 during assembly of a partition run. Fourth, and after assembly and during use of the partitions 10, 11, the clips 35 tend to prevent misalignment of the connected channel members 16*a*, 16*b* upon exposure of the post 12 formed therefrom to a force blow generally normal to the longitudinal axis of the post. Fifth, and because the U-shaped clips tend to lock the opposing channel members 16***a*, 16*b* in true alignment, the entire partition 10, 11 run gains in rigidity and stability.

Having described in detail the preferred embodiment of my invention, what I desire to claim and protect by Letters Patent is:

1. A woven wire partition comprising a frame having at least one channel member as a part thereof, said channel member being oriented to face outwardly relative to the center of said partition, a woven wire panel connected with that channel member, the wire ends of that panel connected with said channel member overlying the interior face of said channel member's center web, and a U-shaped clip mounted within the trough of said channel member, a portion of said U-shaped clip's exterior configuration and size being substantially identical to the interior configuration and size of the trough of said channel member with the base of said U-shaped clip thereby being seated against the center web and sides of that channel member to which it is mounted, said U-shaped clip also having legs that extend beyond the side edges of said channel member, said U-shaped clip's legs being configured to establish an interference fit with the legs of an adjacent outwardly facing channel member during connection of those adjacent channel members in side edge-to-side edge relation, that interfit initially establishing the side edge-to-side edge relation, and thereafter preventing lateral movement between said adjacent channel members during connection of said channel members one with the other.

2. A woven wire partition as set forth in claim 1, the base of said U-shaped clip being interposed between a wire end and the interior face of said channel member, thereby mounting said clip in the trough of said channel member.

3. A woven wire partition as set forth in claim 1 including a nut and bolt connecting said channel members, said U-shaped clip being mounted adjacent to said bolt.

4. A woven wire partition as set forth in claim 1 wherein the sides of said channel members are substantially straight.

5. A woven wire partition comprising a frame having at least one channel member as a part thereof, said channel member being oriented to face outwardly relative to the center of said partition, a woven wire panel connected with that channel member, the wire ends of that panel connected with said channel member overlying the interior face of said channel member's center web, and a U-shaped clip mounted within the trough of said channel member, the base of said U-shaped clip being interposed between a wire end and the interior face of said channel member for mounting said clip in the trough of said channel member, said U-shaped clip having legs that extend beyond the side edges of said channel member, said U-shaped clip's legs being configured to establish an interference fit with the legs of an adjacent outwardly facing channel member during connection of those adjacent channel members in side edge-to-side edge relation, that interfit initially establishing the side edge-to-side edge relation, and thereafter preventing lateral movement between said adjacent channel members during connection of said channel members one with the other.

6. A woven wire partition as set forth in claim 5, a portion of said U-shaped clip's exterior configuration and size being substantially identical to the interior configuration and size of the trough of said channel member, the base of said U-shaped clip thereby being seated against the center web and sides of that channel member to which it is mounted.

7. A woven wire partition as set forth in claim 5 including a nut and bolt connecting said channel members, said U-shaped clip being mounted adjacent to said bolt.

8. A woven wire partition as set forth in claim 5 wherein the sides of said channel members are substantially straight.

* * * * *